US005366152A

United States Patent [19]

Gössi

[11] Patent Number: 5,366,152

[45] Date of Patent: Nov. 22, 1994

[54] HEAT CHARGING APPARATUS

[76] Inventor: Hans Gössi, Oberdorf 25 (6403), Küssnacht am Rigi, Switzerland

[21] Appl. No.: 133,228

[22] Filed: Oct. 7, 1993

[30] Foreign Application Priority Data

Oct. 8, 1992 [CH] Switzerland ..... 92/3152.4

[51] Int. Cl.[5] ..... F25B 27/00

[52] U.S. Cl. ..... 237/2 B; 237/8 C; 62/238.7

[58] Field of Search ..... 237/2 B, 8 R, 8 C; 62/238.6, 238.7

[56] References Cited

U.S. PATENT DOCUMENTS

| | | | |
|---|---|---|---|
| 4,320,630 | 3/1982 | Uselton et al. | 62/238.6 |
| 4,492,091 | 1/1985 | Whitwell et al. | 62/238.6 X |
| 4,955,930 | 9/1990 | Robinson, Jr. | 237/2 B X |
| 5,052,187 | 10/1991 | Robinson, Jr. | 237/2 B X |

FOREIGN PATENT DOCUMENTS

| | | |
|---|---|---|
| 227051 | 7/1987 | European Pat. Off. . |
| 2509442 | 1/1983 | France . |
| 3330097 | 3/1985 | Germany . |

*Primary Examiner*—William E. Tapolcai

*Attorney, Agent, or Firm*—Cushman, Darby & Cushman

[57] ABSTRACT

The heat charging apparatus includes a chair-like frame structure into which a cube-shaped housing is installed about 1 meter from the floor. The housing includes a heat pump, a fan, and other necessary equipment. On its front side the housing is provided with an air intake and on both side walls as well as on the top with air outlets for the pressurized air produced by the fan. The housing is equipped with pipe connections for the supply of warm water as well as for water to be heated as well as with a drip water outlet. The device has a compact design for the housing or the heat pump with a side length of only 55 cm for an output up to 5 kW. As a consequence, the housing with its content is very light and can be replaced by a single unskilled worker so that vast amounts of installation and maintenance costs are saved.

12 Claims, 6 Drawing Sheets

HEAT CHARGING APPARATUS

This application claims priority from Swiss patent application number 3152/92-4, which is incorporated herein by reference.

BACKGROUND OF THE INVENTION

1. Field of the Invention

The invention relates to a heat charging apparatus for water reservoirs and boilers, and especially to a heat charging apparatus for water reservoirs and boilers in heating and warm water installations designed for keeping a selectable minimum temperature.

2. Background Information

A heat pump is designed for air/water, water/water or brine/water, and the conventional heat pumps of the size in question consist of the following elements. In a first conventional model, the heat pump aggregate is directly connected with a warm water-boiler and is either placed on the top or on the side thereof and is known under the designation "HP-Boiler". This design uses a heating spiral, which is directly immersed into the boiler and is connected with the heat pump on the outside thereof for hot water heating.

The disadvantage of this design is that it is not possible to arrange the water in temperature layers from the top to bottom, since the heat spiral does not allow such an arrangement for physical reasons. A further disadvantage of this design that in case of a break-down or a defect of the heat pump, a specialist in air-conditioning or heating is required because the knowledge needed for the repair exceeds that of an average apartment manager. Also, the repair is rather time consuming, so that high repair costs result. Furthermore, it is not possible to remove the problem by means of an exchange unit because such a replacement is too time consuming.

In a second conventional heat pump, the unit is an independent unit that is connected to the heat pump boiler by means of two metal hoses, i.e., one at the bottom and one at the top, whereby the pressure-controlled throttle valve regulates the water quantity and consequently the water temperature.

A disadvantage of this design resides with the fact that such heat pumps are relatively large and consequently need considerable space. Also, this design operates with the cooling means R22, so that the water in the boiler can not be heated up to 60° C., but only up to 50° C. A further important problem is the compensation of circulation losses at low costs by means of the heat pump, which is not possible with this design. Therefore, such losses in this embodiment can only be compensated by means of an electric escort heating that is rather expensive and uneconomical due to high power consumption.

A further disadvantage resides with the fact that such designs have to be assembled at the site where they are installed, thus leading to high installation costs. Also, the charging pump cannot simultaneously be used as circulation pump.

Heat pumps of the design described above are commercially available today and have a heat output limit of 2.5 kW and can consequently not be used for a complete heating system in larger apartment buildings.

SUMMARY OF THE INVENTION

The apparatus of the present invention includes a housing with a built-in heat pump mounted on a frame structure and provided with the necessary connecting means and other fittings for installing the device. A standardized compact heat pump is used that is designed in a small number of sizes and is intended for only a few frame structures and housing sizes. Such frame structures are equipped with all necessary pipe connections, fittings, armatures, thermometers, control valves with drives, circulating pumps and control panel.

The purpose of the present invention, therefore, is to create a heat charging apparatus which does not possess the disadvantages of the prior art discussed above.

The heat pump according to the present invention may be used with heating equipment of the kind described in EP-B-O 277 051.

The heat pump according to the present invention possesses the following advantages over the prior art. First, a standardized, in certain dimensions, manufactured frame structure, on which the entire pipe connections, pipes, armatures, fittings, thermometers, three-way mixing valves with drives, controls, pump, and electrical control panel are mounted, can be installed any place in a room or against a wall. The frame structure needs to be connected to the boiler by means of pipe connections only.

Second, a standardized, cube-shaped, very light heat pump, which is handy and small in size and which is designed for different outputs, can be placed on the erected frame structure. By connecting only two pipes and one, the pump is ready for operation.

The unit is easily replaced by the operator himself or a non-skilled person without specialized training in a few minutes. Furthermore, no repairs at the site are required if replacement aggregates are used, so that service and the replacements in distant places, e.g., in the mountains, are enormously simplified.

The heat pump is operated with a fluid refrigerant, which excludes fluorocarbons, and is thus friendly to the environment and can be used for water temperatures up to 60° C. The heat pump shall compensate for circulation losses without the use of any escort heating, so that a considerable amount is saved on electric energy, thus leading to a very short amortization period for the heat pump.

One or more heat pumps independent of each other are mountable near the boiler or water reservoir and are in a position to recover excessive heat, for air conditioning as well as for dehumidization of basements and laundry rooms.

The frame structure with the entire piping and the electric control is supplied ready for operation so that the installation can be put into service by a one without specialized training.

It has been found that a cube-shaped housing is the best shape for the receipt of the exhaust and supply air, the compressor, and the evaporator so that the smallest possible volume is occupied for different outputs. The side length for an output of up to 5 kW is only 55 cm, which length in comparison with existing designs means a vast reduction of size.

BRIEF DESCRIPTION OF THE DRAWINGS

Other objects, features, and characteristics of the present invention, as well as method of operation and functions of the related elements of the structure, will become apparent upon consideration of the following description and the appended claims with reference to the drawings, all of which form a part of this specification, wherein like reference numerals designate corresponding parts in the various figures. In the drawings:

DETAILED DESCRIPTION OF THE INVENTION

Figure 1:
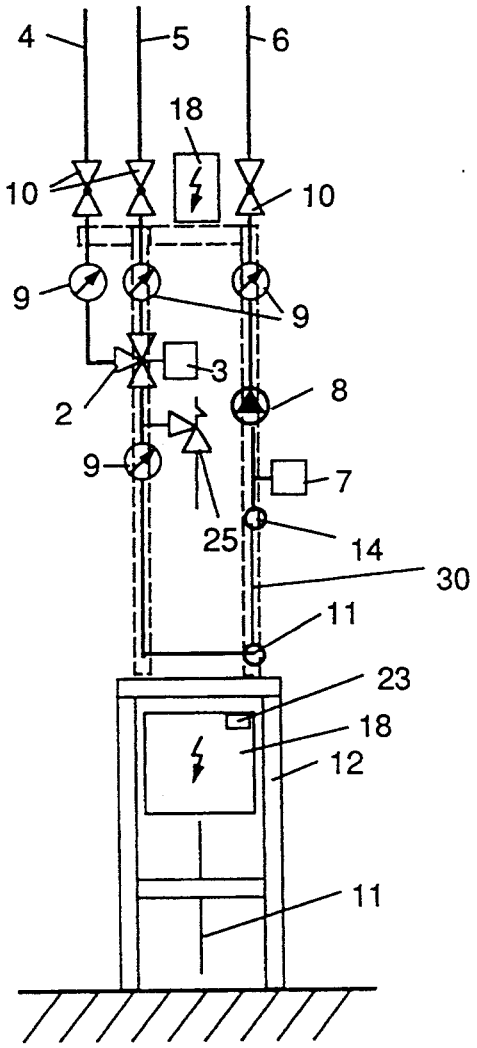
FIG. 1 shows schematically the front side of the frame structure with the complete piping but without the heat pump housing.
Figure 2:
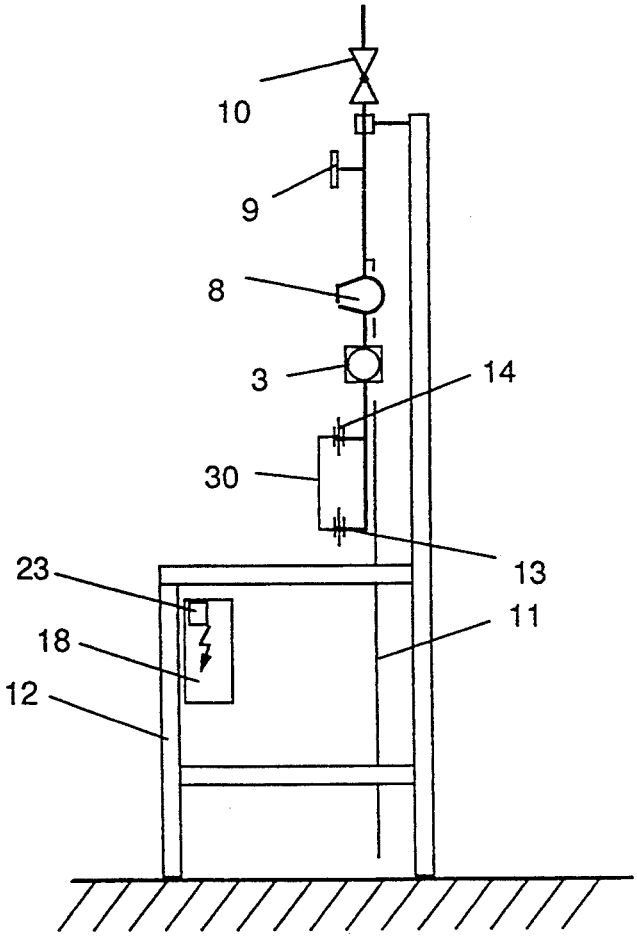
FIG. 2 shows a schematic side view of FIG. 1.

FIGS. 1 and 2 show a chair-like frame structure 12 including the entire piping ready for connection to the housing 1 (FIG. 3) with the heat pump. The frame structure can be mounted anywhere in the room, including on the wall thereof. On two different pipe connections, which are a defined distance from each other, the heat pump can be connected to the piping when the housing has been mounted.

Figure 3:
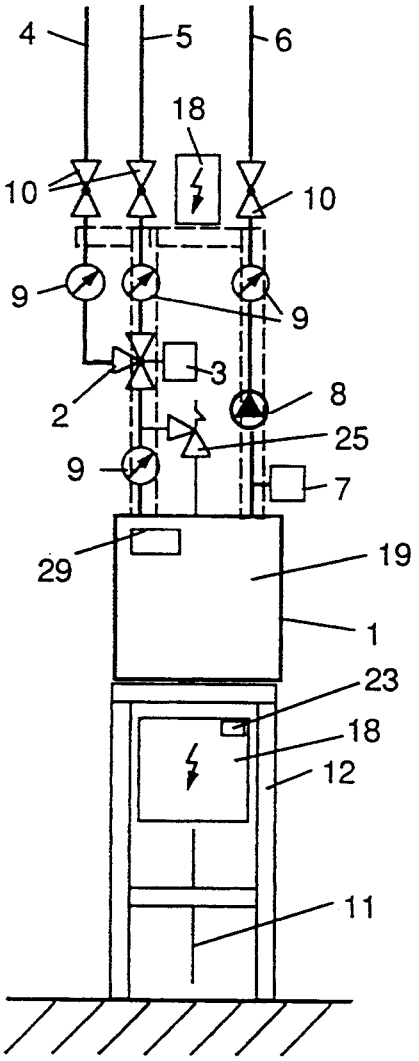
FIG. 3 shows a front view of the frame structure of FIGS. 1 and 2 with a mounted heat pump housing.

A mixing valve 2 with a drive 3 as well as a pipe 4 for the lower water level in a water reservoir or a boiler 15 (FIG. 5), a pipe 5 for the upper water level, and a pipe 6 for a warm water supply are shown. The pipes 4 and 5 are connected via stop valves 10, 10*a* and thermometers 9, 9*a* with the mixing valve 2 having the drive 3 and a cable connection 23 to the heat pump 1 (FIG. 3). Parallel to the cable connection 23 a security or overpressure valve 25 is installed. A pipe connection 13 is placed between the cable connection 23 and the heat pump 1.

The pipe 6 is connected via a stop value 10*b*, a thermometer 9*b*, a charging or circulation pump 8, a further electro-register 26 with the screwed pipe connection 14. A temperature control device 7 is installed in front of the pipe or screw connection 14.

Figure 4:
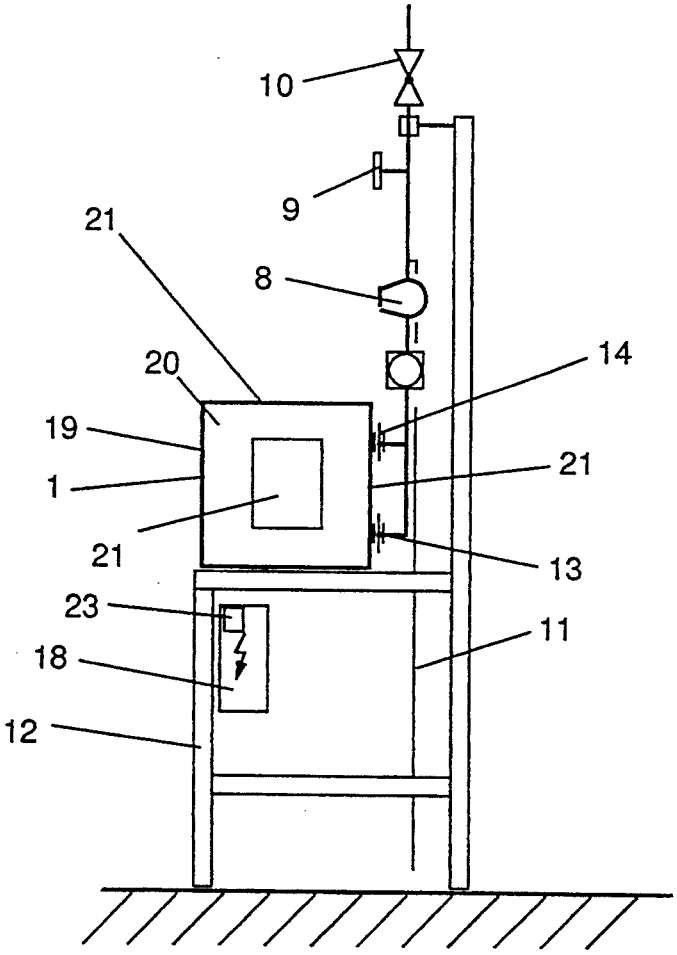
FIG. 4 shows a side view of FIG. 3.

FIGS. 3 and 4 show the entire charging apparatus with frame structure 12, including wiring as well as a mounted cube-shaped heat pump. The connective set-up corresponds to the one shown in EP-B-O 227 051.

The housing of the heat pump 1 is connected with the pipe screw connections 13 and 14 and at the bottom with a drip water pipe 11*a*, whereby one of the pipes 13 is connected with the drive 3 operating the mixing valve 2. This valve 2 receives water from two different layers in a water reservoir or boiler 15 (FIG. 5) and supplies the water mixture selected by the drive 3 to the heat pump in the housing 1. From the condenser of the heat pump 1 the heated water flows through the pipe 14 into the piping and also a portion thereof into the boiler or water reservoir 15.

The housing 1 is mounted on the frame structure 12. The housing 1 includes an independent heat pump unit and has on the back side connections for the two pipes 13 and 14 as well as for the drop water pipe 11*a*. The housing 1 is connected via a flexible plastic or rubber hose connected to the drop water pipe 11*a*. A cable with connector 23 is mounted on the housing 1 for the electrical connection to the control panel 18.

The housing 1 has the same dimensions for all outputs within certain limits and a side length of 55 cm for an output up to 5 kW.

In the housing 1, all parts are installed which are needed for the heat pump, such as an evaporator, a compressor, an expansion valve, a condenser and a thermostat.

On the back side 22 of the housing 1 an air filter or grid 21 is installed through which the surrounding air is drawn via a fan. Through air grids 21 on the connecting side walls 20, 20' and on the top of the housing, the air is blown back into the room.

Figure 5:
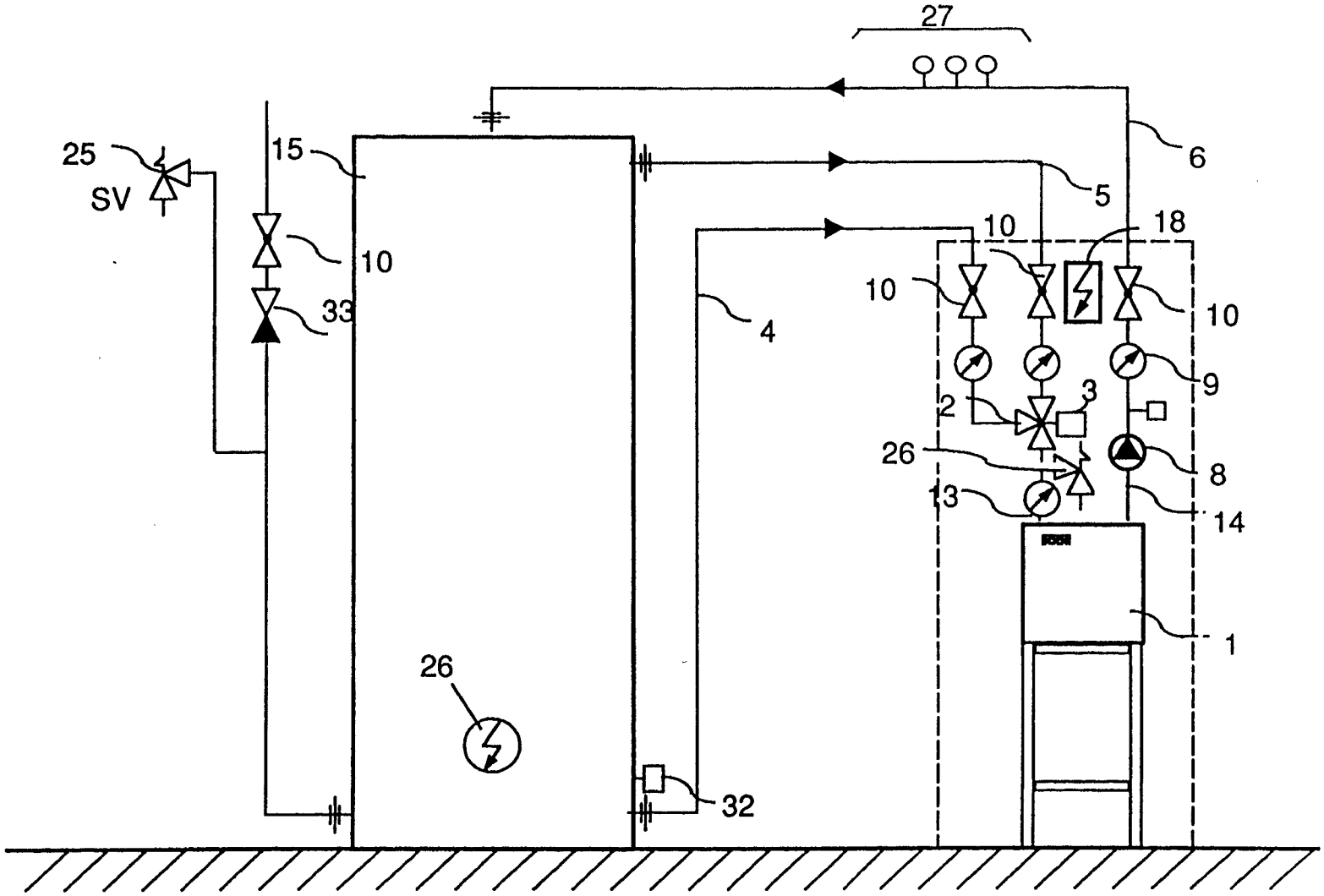
FIG. 5 shows an application of the heat pump in a water circuit for charging boilers with simultaneous compensation of the circulation water heat losses.
Figure 6:
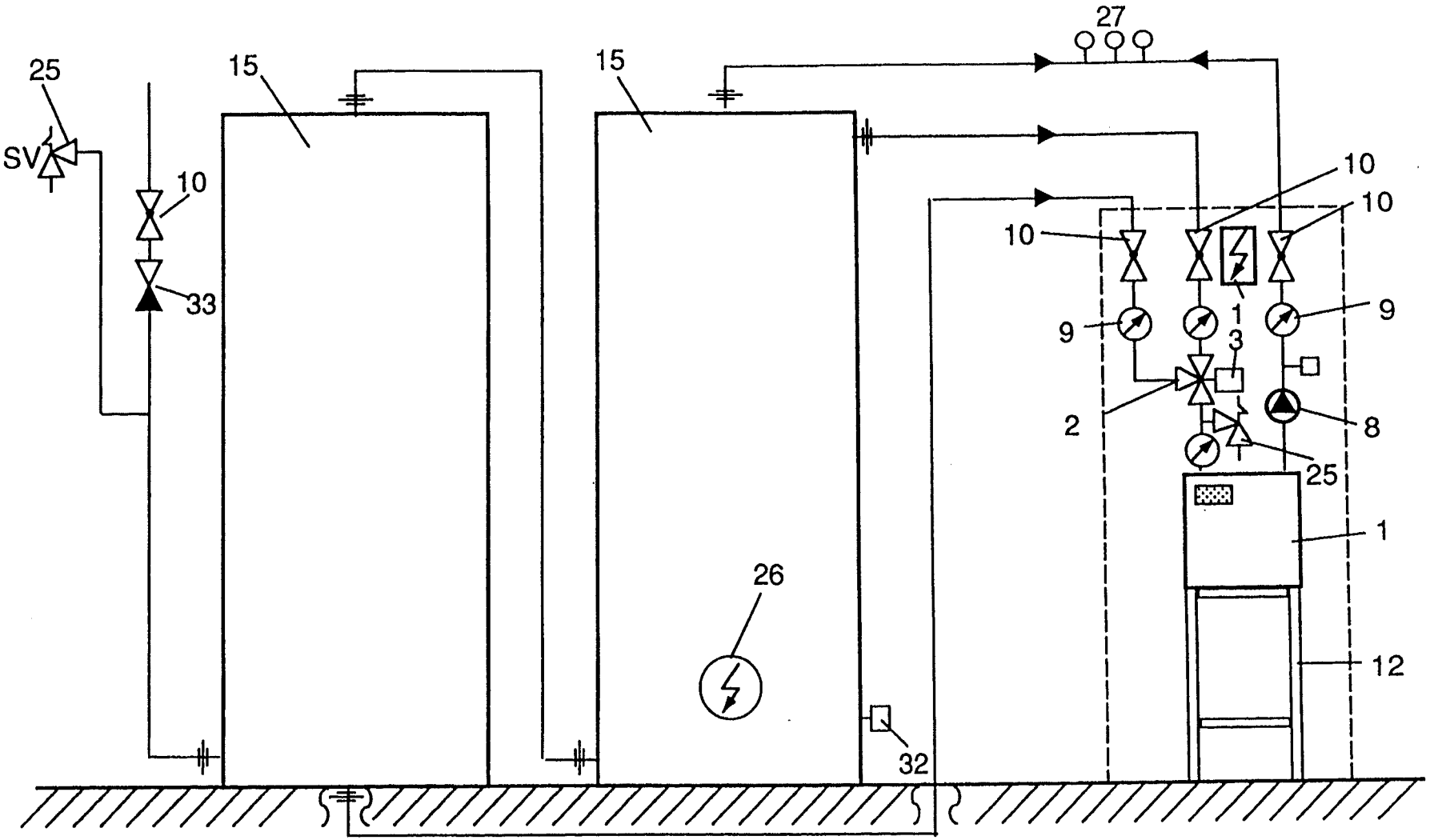
FIG. 6 shows the embodiment of FIG. 5, but with two boilers.
Figure 7:
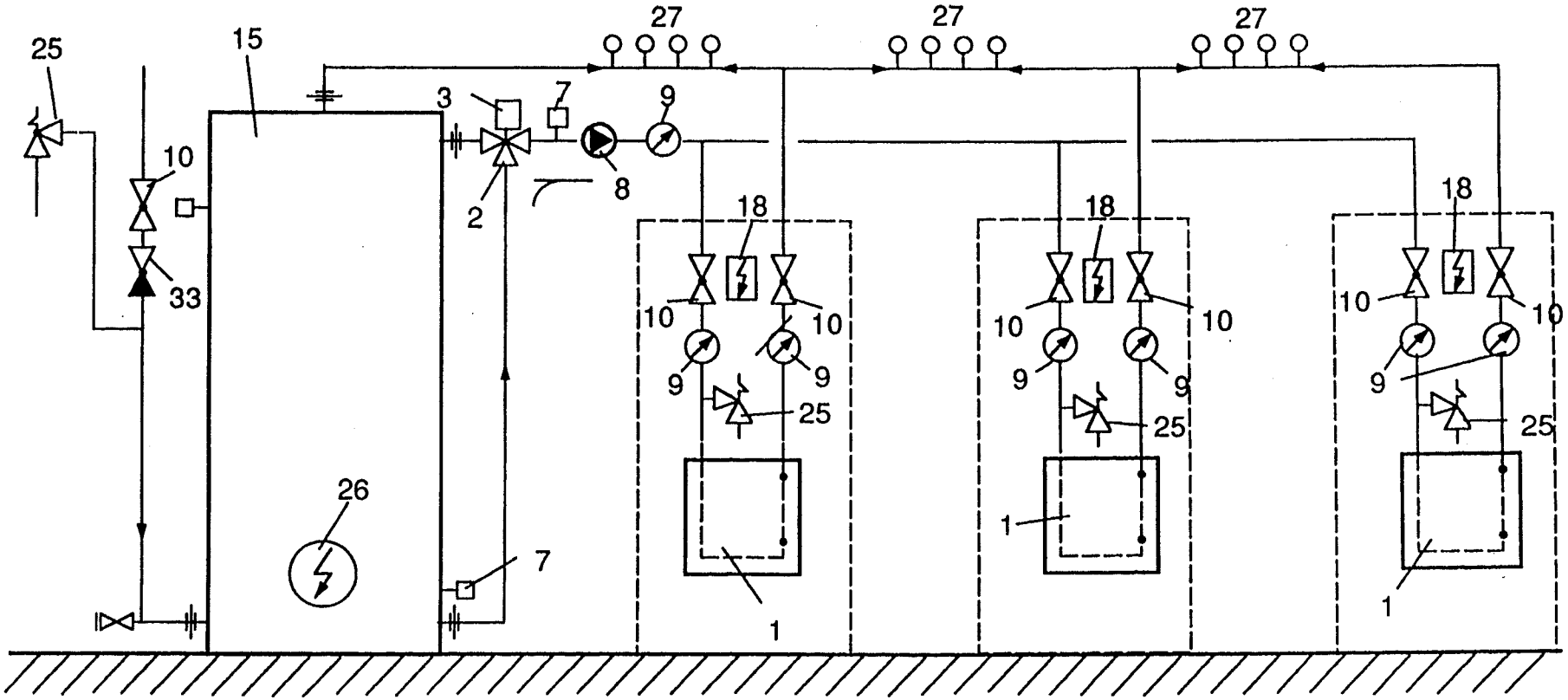
FIG. 7 shows several independent apparatuses installed at different locations and working together in a parallel arrangement.
Figure 8:
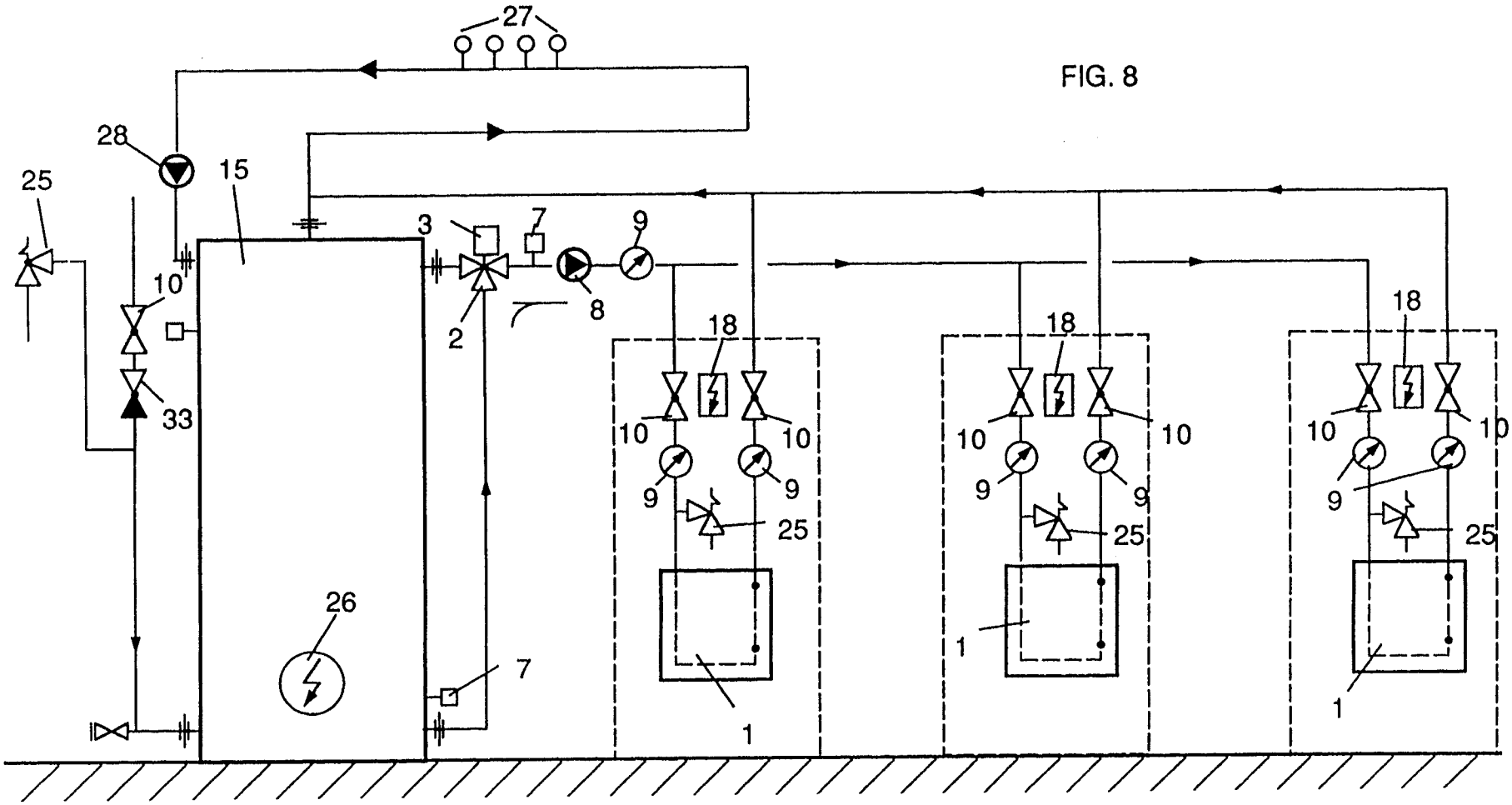
FIG. 8 shows the embodiment of FIG. 6, but with a warm water pipe connected with the circulation in the boiler.

FIGS. 5 through 8 show the application of heat charge apparatuses in different warm water plants, whereby FIGS. 5, 7, and 8 show only one boiler, with two being depicted in FIG. 6. FIGS. 5 and 6 show one heat pump each, while three parallel connected heat pumps 1 are used in FIGS. 7 and 8. In the case of FIG. 7, the individual pumps comprise a group of water outlets 27, while in FIG. 8, all heat pumps together supply one group of water outlets 27. Furthermore, FIGS. 5 to 8 each show one circulation pump 28, one In-Out-Switching thermometer 29 and one connecting element 30. In addition, one non-return valve 31 is provided.

The different embodiments are applied according to the individual requirements of the installation, depending on the water consumption at the different water outlets. The heat pump apparatus cannot only be used as a warm water heater, but also as a drying means and humidity reducing device in laundry drying rooms, and as an air conditioner. This additional feature of the apparatus is possibly one of the most important parts of the present invention.

The heat charging apparatus, therefore, has the following additional advantageous features which are not associated with any disadvantages whatsoever. The apparatus produces hot water. Further, the apparatus removes humidity from the surrounding atmosphere so that it can be advantageously used for laundry drying. Further, the apparatus reduces the temperature of the surrounding air, meaning that it works like an conditioning device.

All these features together makes its suitable for family homes, apartment buildings and also factories, in which a dry or cold air is required.

If no cold air is needed, as may be the case during the winter, the cold air can be led to the outside of the building in which the apparatus is installed.

Further advantages of the unit described are the small dimensions, the compact size, the almost noiseless operation as well as the low weight of the housing with its content. In case of a break-down, the heat pump can be replaced in a few minutes by disconnecting the screwed pipe connections 11, 13, and 14 and the electric connector. Such replacements of the unit does not require any skilled person and can be carried out so fast that persons in the building will not even notice any transitory reductions in the temperature of the water they are using. This is a very important feature, particularly during cold winter days.

While the invention has been described in connection with what is presently considered to be the most practical and preferred embodiment, it is to be understood that the invention is not to be limited to the disclosed embodiment, but rather, is intended to cover various modifications and equivalent arrangements included within the spirit and scope of the appended claims.

What is claimed is:

1. A heat charging apparatus for water reservoirs and boilers in heating and warm water installations designed for keeping a selectable minimum temperature, said heat charging apparatus comprising:

a water circulation pump located in a piping system for pumping water to and from the reservoir or boiler, a temperature control, a three-way mixing valve located in piping system for receiving water from different locations of the reservoir or boiler and mixing the same, an electric control panel on which the temperature control is located, and a heat pump located in the piping system for receiving and heating the water from the reservoir or boiler, wherein said charging apparatus includes a frame structure with a chair-like support area for the heat pump built into a housing, wherein the frame structure includes pipe connections and a wired control panel, and wherein the housing is cube-shaped and is removably connected to a water circuit via the pipe connections and to the control panel by means of an electric connector.

2. An apparatus according to claim 1, wherein the housing includes a back side provided with one of an intake grid and filter, with said filter covering an air evaporating device, wherein air outlet openings are disposed in side walls and a top wall of the housing, wherein the housing includes on a vertical wall thereof an electronic temperature indicator with an integrated In-and-Out-switching thermostat, and wherein the electrical connector is disposed in a rear wall of the housing.

3. An apparatus according to claim 1, wherein the frame structure with pipes can be mounted one of free-standing and juxtapose a wall, and wherein the housing with the heat pump is adapted to be mounted at a height of 1 m above a floor.

4. An apparatus according claim 3, wherein the heat pump is adapted to operate with a fluorocarbon-free refrigerant.

5. An apparatus according to claim 4, wherein the heat pump includes a screwable pipe connection and said electric connector is adapted to be pulled from its connection to unhook said electric connector.

6. An apparatus according to claim 1, wherein said pipe connections include two pipes at a bottom and at a top that are connected with one of a warm water reservoir and a pipe and the warm water circulation, and wherein a third pipe is connected with the mixing valve at a bottom of a boiler.

7. An apparatus according to claim 1, wherein said heat charging apparatus is adapted to charge a warm water reservoir as well as to compensate for water circulation temperature losses.

8. An apparatus according to claim 1, wherein a side length of the cube-shaped housing for an output of 5 kW is 55 cm.

9. An apparatus according to claim 1, wherein at least one heat pump, independent of the position of the boiler, can be used for the climatization of rooms as well as for removing humidity from rooms.

10. An apparatus according to claim 1, wherein said heat charging apparatus includes a charging pump that at the same time serves as a circulation pump, and that it is designed for non-stop operation.

11. An apparatus according to claim 7, wherein the warm-water reservoir includes an electro-register at the bottom thereof adapted for hourwise operation.

12. An apparatus according to claim 6, wherein the heat charging apparatus includes a flow in a circulation pipe going from the heat pump to the boiler via a supply pipe.

* * * * *